US006727004B2

(12) United States Patent
Goulet et al.

(10) Patent No.: US 6,727,004 B2
(45) Date of Patent: Apr. 27, 2004

(54) MULTI-PLY PAPER SHEET WITH HIGH ABSORBENT CAPACITY AND RATE

(75) Inventors: Mike Thomas Goulet, Neenah, WI (US); Mark Alan Burazin, Oshkosh, WI (US); Yu Cui, Fall River, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 42 days.

(21) Appl. No.: 10/205,165

(22) Filed: Jul. 24, 2002

(65) Prior Publication Data

US 2004/0018369 A1 Jan. 29, 2004

(51) Int. Cl.[7] ..... B32B 23/04; B32B 23/00

(52) U.S. Cl. ..... 428/532; 428/534; 428/535; 428/536; 428/537.5; 428/153; 428/154; 428/219; 162/9; 162/123

(58) Field of Search ..... 428/532, 534, 428/535, 536, 537.5, 153, 154, 219; 162/123, 9

(56) References Cited

U.S. PATENT DOCUMENTS

| | | | | |
|---|---|---|---|---|
| 5,316,623 A | | 5/1994 | Espy | |
| 5,399,412 A | * | 3/1995 | Sudall et al. | 428/153 |
| 5,772,845 A | | 6/1998 | Farrington, Jr. et al. | |
| 6,017,417 A | | 1/2000 | Wendt et al. | |
| 6,238,519 B1 | * | 5/2001 | Jones et al. | 162/123 |
| 6,458,243 B1 | * | 10/2002 | Jones et al. | 162/127 |

FOREIGN PATENT DOCUMENTS

| | | | |
|---|---|---|---|
| EP | 0 549 925 A1 | | 7/1993 |
| WO | WO 00/08253 A1 | | 2/2000 |
| WO | WO 00/08253 | * | 2/2000 |

* cited by examiner

*Primary Examiner*—Leszek Kiliman
(74) *Attorney, Agent, or Firm*—Gregory E. Croft

(57) ABSTRACT

Multi-ply paper towels are disclosed which have a combination of high absorbent capacity and a high rate of absorbency. These properties are the result of a combination of the intra-ply fiber structure and a network of inter-ply wet-collapse resistant channels that distribute and retain absorbed liquid.

38 Claims, 2 Drawing Sheets

MULTI-PLY PAPER SHEET WITH HIGH ABSORBENT CAPACITY AND RATE

BACKGROUND OF THE INVENTION

In the business of developing and manufacturing paper towels for the consumer market, it is a continual objective to improve the absorbent characteristics of the product. For cleaning up some spills, the consumer needs high absorbent capacity. For some uses, consumers want a fast rate of absorbency. For other uses, a combination of high absorbent capacity and fast absorbent rate is desired. At the same time, constraints on achieving this objective include the need to maintain or reduce costs in order to provide the consumer with the highest possible value, which in part means minimizing the amount of fiber in the product.

SUMMARY OF THE INVENTION

It has now been discovered that the absorbent characteristics of multi-ply paper towel products can be improved by providing an inter-ply, wet-collapse resistant open channel structure within the product as well as providing an intra-ply pore structure that is conducive to good absorbent characteristics. In addition to the absorbent characteristics provided by the fibers and the intra-ply fiber network pore structure, the inter-ply channels also contribute to absorbency by readily wicking away liquid and rapidly distributing the liquid to other areas of the product that are not yet saturated, as well as providing reservoirs for holding absorbed liquid. This wet-collapse resistant open channel structure can take the form of relatively straight and long channels or it can the form of a more tortuous path imparted to the surface of the plies by various papermaking fabric contours and embossing patterns. One convenient method of creating such channels is to ply together multiple low basis weight uncreped throughdried plies which have a highly contoured surface of multiple ridges and which inherently have wet-collapse resistance due to the manner in which they are formed, processed and dried. However, other means of providing suitable wet-collapse resistance include the use of appropriate fibers, including synthetic fibers, crimped fibers and pre-crosslinked fibers, optionally in conjunction with suitable converting operations such as heated embossing to shape the structure, or using any means of drying a wet sheet into a three-dimensional configuration during manufacturing or converting of the paper such that the paper retains the three-dimensional shape when wetted with water.

Hence, in one aspect, the invention resides in a multi-ply paper sheet, such as a paper towel, having two or more plies, said sheet having a Vertical Absorbent Capacity of about 8.0 grams of water or greater per gram of fiber and a Wet Out Time of 2.3 seconds or less.

In another aspect, the invention resides in a multi-ply paper towel having two or more throughdried plies, including uncreped throughdried plies, said towel having a Vertical Absorbent Capacity of about 8.0 grams of water or greater per gram of fiber and a Wet Out Time of 2.3 seconds or less.

In the various aspects of this invention, the Vertical Absorbent Capacity can be about 8.0 grams of water or greater per gram of fiber, more specifically about 9.0 grams of water or greater per gram of fiber, more specifically about 10.0 grams of water or greater per gram of fiber, more specifically from about 8.0 to about 16.0 grams of water per gram of fiber, more specifically from about 9.0 to about 15.0 grams of water per gram of fiber, and still more specifically from about 10.0 to about 15.0 grams of water per gram of fiber.

In the various aspects of the invention, the Wet Out Time can be about 2.3 seconds or less, more specifically about 2.0 seconds or less, more specifically about 1.5 seconds or less, more specifically from about 0.5 to 2.3 seconds, more specifically from about 0.5 to about 2.0 seconds, more specifically from about 0.5 to about 1.5 seconds, and still more specifically from about 0.9 to about 1.5 seconds.

Factors which reduce the Wet Out Time include: enlarging the pore size of the plies, which can be achieved by using more three-dimensional throughdrying fabrics as described herein; reducing the basis weight of the plies; fiber selection; decreasing the amount of refining of the fibers; selecting hydrophilic chemical additives; increasing the amount of surfactant in the furnish.

The number of plies in the product can be two, three, four, five or more. For economy, two-ply and three-ply products are advantageous. The various plies within any given multi-ply sheet can be the same or different. By way of example, the various plies can contain different fibers, different chemicals, different basis weights, or be made differently to impart different topography. Different processes include throughdrying, creped or uncreped, wet-pressing or modified wet-pressing. Wet molded throughdried plies, such as uncreped throughdried plies, have been found to be particularly advantageous because of their wet resiliency and three-dimensional topography.

The fibers used to form the plies of the products of this invention can be substantially entirely hardwood kraft or softwood kraft fibers. However, other fibers can also be used for part of the furnish, such as mechanical pulp fibers, bleached chemithermomechanical pulp (BCTMP) fibers, synthetic fibers, pre-crosslinked fibers, non-woody plant fibers, and the like. More specifically, the fibers can be from about 50 to about 100 percent softwood kraft fibers, more specifically from about 60 to about 100 percent softwood kraft fibers, still more specifically from about 70 to about 100 percent softwood kraft fibers, still more specifically from about 80 to about 100 percent softwood kraft fibers, and still more specifically from about 90 to about 100 percent softwood kraft fibers. While not being bound to any particular theory, it is believed that throughdried sheets formed primarily from virgin softwood kraft fibers have a particularly desirable internal pore structure that synergistically interacts with the wet-collapse resistant channels to provide the improved absorbent properties observed.

The basis weight of the plies used to produce the multi-ply products of this invention can be about 40 gsm or less, more specifically about 30 gsm or less, more specifically about 20 gsm or less, still more specifically from about 10 to about 20 gsm, and still more specifically from about 10 to about 15 gsm.

As used herein, "Vertical Absorbent Capacity" is a measure of the amount of water absorbed by the paper towel product, expressed as grams of water absorbed per gram of fiber (dry weight) in the product. In particular, the Vertical Absorbent Capacity is determined by cutting a sheet of the product to be tested into a square measuring 100 millimeters by 100 millimeters (±1 mm.) The specimen is weighed to the nearest 0.01 gram and the value is recorded as the "Dry Weight". The specimen is placed into a dish of water and soaked in the water for 3 minutes (±5 seconds). At the end of the soaking time, the specimen is removed from the water and hung from one corner in a clamping device such that the opposite corner is lower than the rest of the specimen. The specimen is allowed to drain for 3 minutes (±5 seconds). At the end of the specimen draining time, the specimen is removed by holding a weighing dish under the specimen and releasing it from the clamping device. The wet specimen is then weighed to the nearest 0.01 gram and the value recorded as the "Wet Weight". The Vertical Absorbent Capacity=(Wet Weight—Dry Weight)/Dry Weight. At least five (5) replicate measurements are made on the same sample to yield an average Vertical Absorbent Capacity value.

The absorbent capacity of the multi-ply products of this invention, on an equivalent pore volume basis as measured by capillary suction, is such that about 50 percent or more of the total pore volume resides in pores having a radius of 250 micrometers or greater.

As used herein, "Wet Out Time" is a measure of how fast the paper towel product absorbs water and reaches its absorbent capacity, expressed in seconds. In particular, the Wet Out Time is determined by selecting and cutting 20 representative product specimen sheets into squares measuring 63 millimeters by 63 millimeters (±3 mm.). The resulting pad of 20 product sheets is stapled together across each corner of the specimen pad just far enough from the edges to hold the staples. The staples should be oriented diagonally across each corner and should not wrap around the edges of the test specimen. With the staple points facing down, the specimen is held horizontally over a pan of water approximately 25 millimeters from the surface of the water. The specimen is dropped flat onto the surface of the water and the time for the specimen to become visually completely saturated with water is recorded. This time, measured to the nearest 0.1 second, is the Wet Out Time for the product. At least five (5) replicate measurements are made on the same sample to yield an average Wet Out Time value.

DETAILED DESCRIPTION OF THE DRAWINGS

Figure 1:
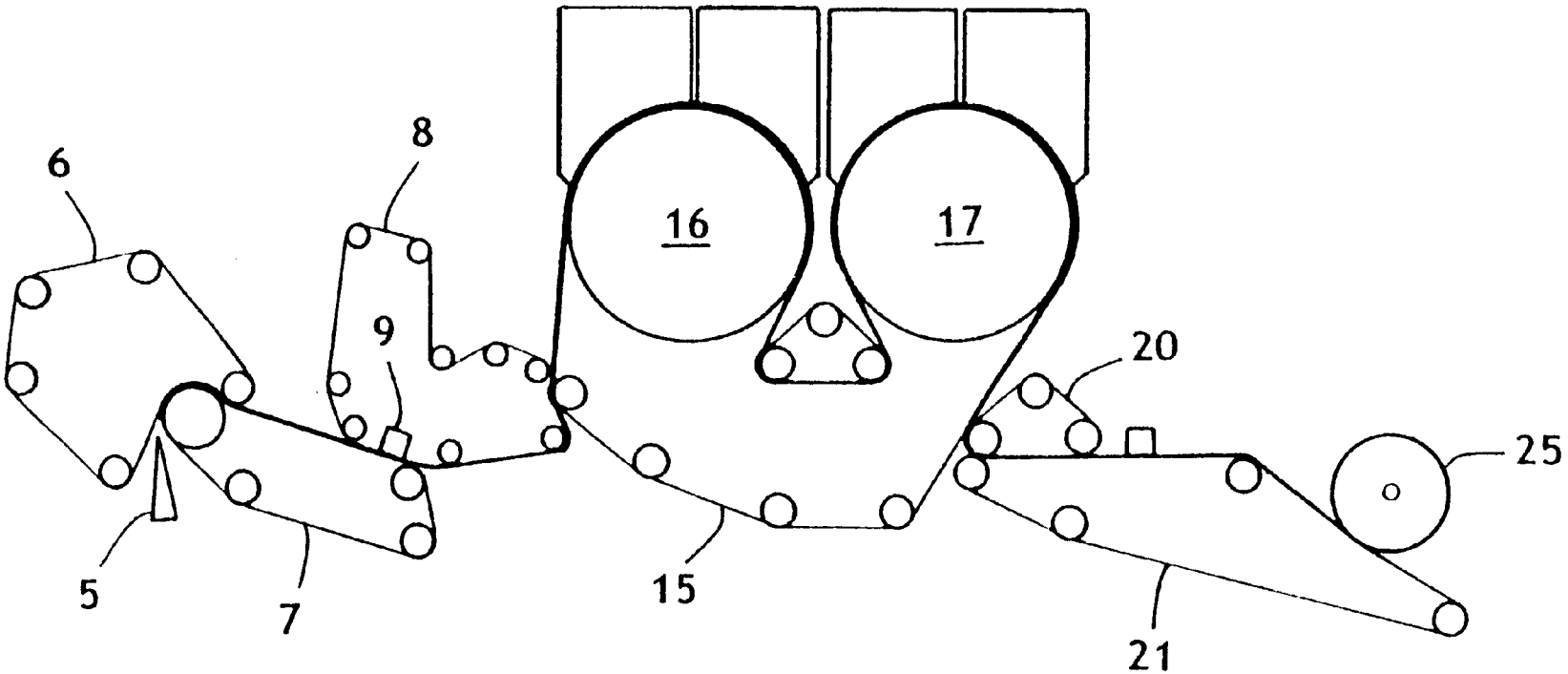
FIG. 1 is a schematic illustration of an uncreped through-dried tissue making process suitable for purposes of making basesheet plies in accordance with this invention.

FIG. 1 is a schematic illustration of an uncreped through-dried process useful for making basesheet plies suitable for purposes of this invention. In particular, shown is an uncreped through-air-dried tissuemaking process in which a headbox 5 deposits an aqueous suspension of papermaking fibers between forming wires 6 and 7. The newly-formed web is transferred to a slower moving transfer fabric with the aid of a vacuum box 9. The web is then transferred to a throughdrying fabric 15 and passed over throughdryers 16 and 17 to dry the web. Suitable throughdrying fabrics for purposes herein include, without limitation, fabrics disclosed in U.S. Pat. No. 6,017,417 to Wendt et al. entitled "Method of Making Soft Tissue Products," which is hereby incorporated by reference.

After drying, the web is transferred from the throughdrying fabric to fabric 20 and thereafter briefly sandwiched between fabrics 20 and 21. The dried web remains with fabric 21 until it is wound up into a parent roll 25.

Figure 2:
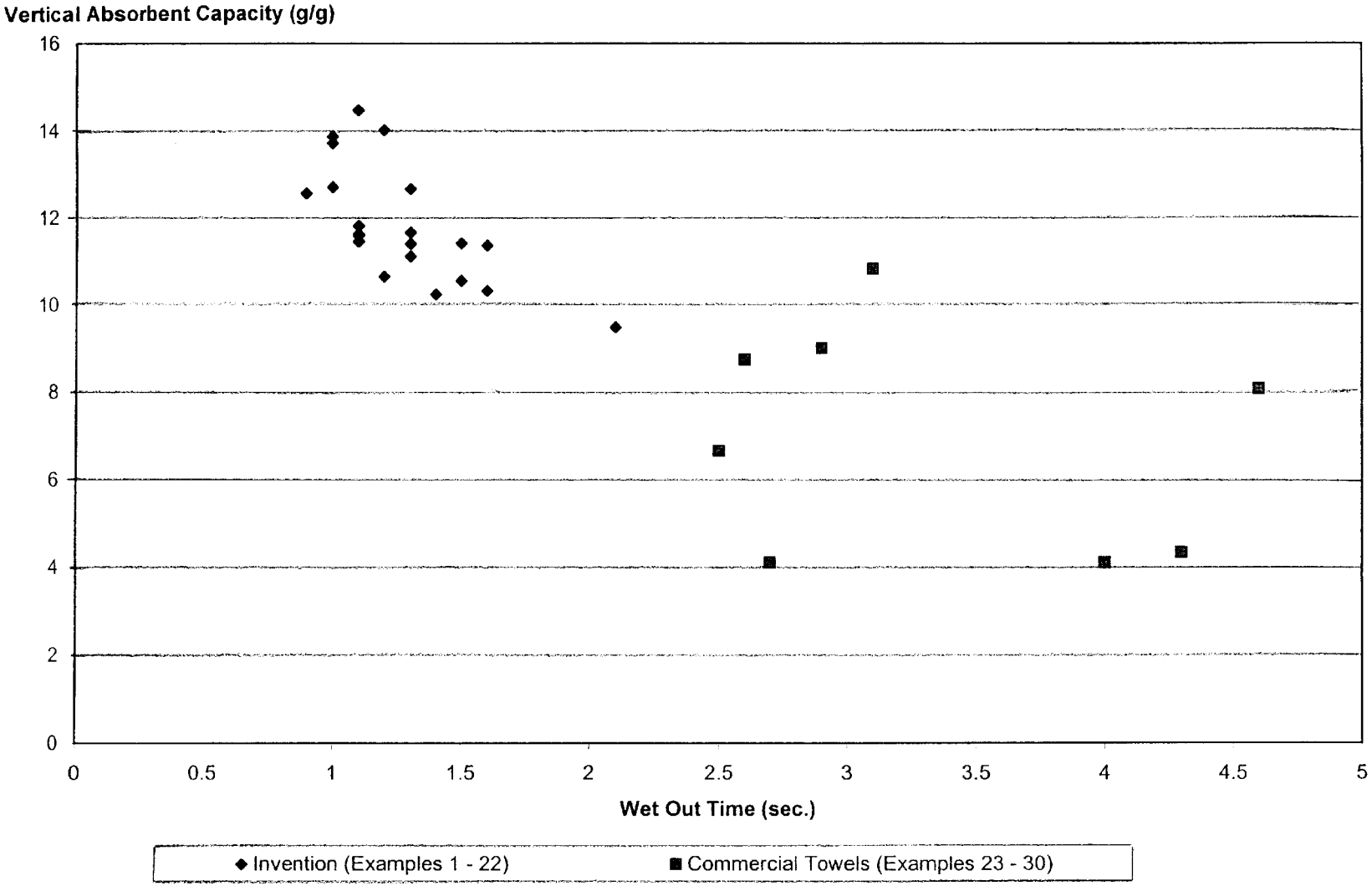
FIG. 2 is a plot of the Vertical Absorbent Capacity versus the Wet Out Time for paper towel products of this invention made in accordance with the Examples described below and several commercially available paper towel products, illustrating the unique absorbency properties of the products of this invention.

FIG. 2 is further described in connection with the Examples below.

EXAMPLES

Example 1

A pilot tissue machine was used to produce non-layered, uncreped throughdried towel basesheets generally as described in FIG. 1. The basesheets were then converted into two-ply or three-ply finished product towel rolls in a conventional manner.

More specifically, 75 lbs of bleached northern softwood kraft fiber was dispersed in a pulper for 30 minutes at a consistency of 3 percent. The thick stock slurry was then passed through a refiner and refined to approximately 600 ml Canadian Standard Freeness. The thick stock was then sent to a machine chest and blended with 25 lbs bleached northern softwood chemi-thermomechanical fiber (dispersed at 3 percent consistency, but not refined) and diluted to a consistency of 1 percent. A polyamide epichlorohydrin wet strength resin (Kymene 557LX commercially available from Hercules Inc. in Wilmington, Del.) was added first, followed by the addition of a sodium carboxymethylcellulose dry strength additive (Aqualon CMC 7MT, Hercules Inc.). The Kymene 557LX diluted to approximately 1 percent active solids, was pumped into the stock outlet from the stuffbox by a chemical addition pump at 400 mL/min. This equates to a wet strength chemical addition level of 25 lbs Kymene 557LX/tonne of dry fiber. The CMC, diluted to 0.75% with warm water and agitation, was pumped into the stock flow pipe between the stuffbox and the fan pump using a chemical addition pump. The CMC addition point was located such that the addition occurred only a few seconds after the Kymene addition point. The CMC was supplied at a flow rate of 150 mL/min, which equates to 8 lbs CMC/tonne of dry fiber.

The machine chest furnish containing the chemical additives was diluted to approximately 0.1 percent consistency and delivered to the forming fabric (Voith Fabrics, 2164-B33) using a flow spreading headbox. The forming fabric speed was approximately 50 fpm. The basesheet was then rush transferred to a transfer fabric (Voith Fabrics, 2164-B33) traveling 25% slower than the forming fabric using a vacuum shoe to assist the transfer. At a second vacuum shoe assisted transfer, the basesheet was transferred and wet-molded onto the throughdrying fabric (Voith Fabrics, t1203-2). The sheet was dried with a throughdryer operating at a temperature of 375° C. The resulting basesheet had an oven dry basis weight of 13.6 grams per square meter (gsm).

The converting line was set up in such a way that two basesheet rolls were unwound, calendered using a steel/rubber calendar arrangement engaged at 5 mm of interference, plied together using crimping wheels, and rewound onto finished product cores. In the finished product, the side of the basesheet that was against the throughdryer fabric was facing outward.

All testing of absorbency properties was done on finished product. The resulting two-ply towel had a Vertical Absorbent Capacity of 12.57 grams per gram (g/g) and a Wet Out Time of 0.9 seconds (s).

Example 2

A two-ply towel was produced as described in Example 1, except the basis weight of each ply was 17.0 gsm. The towel had a Vertical Absorbent Capacity of 11.63 g/g and a Wet Out Time of 1.1 seconds.

Example 3

A two-ply towel was produced as described in Example 1, except the basis weight of each ply was 20.4 gsm. The towel had a Vertical Absorbent Capacity of 11.12 g/g and a Wet Out Time of 1.3 seconds.

Example 4

A two-ply towel was produced as described in Example 1, except the basis weight of each ply was 23.8 gsm. The towel had a Vertical Absorbent Capacity of 10.56 g/g and a Wet Out Time of 1.5 seconds.

Example 5

A two-ply towel was produced as described in Example 1, except the basis weight of each ply was 27.2 gsm. The towel had a Vertical Absorbent Capacity of 10.33 g/g and a Wet Out Time of 1.6 seconds.

Example 6

A two-ply towel was produced as described in Example 1, except the throughdrying fabric used was a Voith Fabrics t4803-7 and the basis weight of each ply was 27.2 gsm. The towel had a Vertical Absorbent Capacity of 10.25 g/g and a Wet Out Time of 1.4 seconds.

Example 7

The basesheet of a three-ply towel was produced as describe in Example 1, except the throughdrying fabric used was a Voith Fabrics t4803-7, and the basis weight of each ply was 27.2 gsm. The converting line was set up in such a way that three basesheet rolls were unwound, calendered using a steel/rubber calendar arrangement engaged at 5 mm of interference, plied together using crimping wheels, and rewound onto finished product cores. The resulting three-ply towel had a Vertical Absorbent Capacity of 11.41 grams per gram (g/g) and a Wet Out Time of 1.3 seconds.

Example 8

A two-ply towel was produced as described in Example 1, except the throughdrying fabric used was a Voith Fabrics t4803-7 and the basis weight of one ply was 27.2 gsm and that of the other ply was 13.6 gsm. The towel had a Vertical Absorbent Capacity of 10.66 g/g and a Wet Out Time of 1.2 seconds.

Example 9

A two-ply towel was produced as described in Example 1, except the throughdrying fabric used was a Voith Fabrics t116-3 and the basis weight of each ply was 27.2 gsm. The towel had a Vertical Absorbent Capacity of 10.56 g/g and a Wet Out Time of 1.5 seconds.

Example 10

The basesheet of a three-ply towel was produced as describe in Example 1, except the throughdrying fabric used was a Voith Fabrics t116-3 and the basis weight of each ply was 20.4, 27.2 (center ply), and 20.4 gsm respectively. The converting line was set up in such a way that three basesheet rolls were unwound, calendered using a steel/rubber calendar arrangement engaged at 5 mm of interference, plied together using crimping wheels, and rewound onto finished product cores. The resulting three-ply towel had a Vertical Absorbent Capacity of 11.37 grams per gram (g/g) and a Wet Out Time of 1.6 seconds.

Example 11

A two-ply towel was produced as described in Example 1, except the throughdrying fabric used was a Voith Fabrics t116-3 and the basis weight of each ply was 20.4 gsm. The towel had a Vertical Absorbent Capacity of 11.46 g/g and a Wet Out Time of 1.1 seconds.

Example 12

A two-ply towel was produced as described in Example 1, except the throughdrying fabric used was a Voith Fabrics t4803-7 and the basis weight of each ply was 20.4 gsm. The towel had a Vertical Absorbent Capacity of 11.82 g/g and a Wet Out Time of 1.1 seconds.

Example 13

A two-ply towel was produced as described in Example 1, except the throughdrying fabric used was a Voith Fabrics t4803-7 and the basis weight of each ply was 20.4 gsm. The towel had a Vertical Absorbent Capacity of 11.67 g/g and a Wet Out Time of 1.3 seconds.

Example 14

A two-ply towel was produced as described in Example 1, except the throughdrying fabric used was a Voith Fabrics t4803-7 and the basis weight of each ply was 20.4 gsm. Also, the finished product was wound such that the throughdryer fabric side of both plies faced inward. The towel had a Vertical Absorbent Capacity of 11.60 g/g and a Wet Out Time of 1.1 seconds.

Example 15

A two-ply towel was produced as described in Example 1, except the throughdrying fabric used was a Voith Fabrics t4803-7 and the basis weight of each ply was 13.6 gsm. The towel had a Vertical Absorbent Capacity of 12.71 g/g and a Wet Out Time of 1.0 seconds.

Example 16

A two-ply towel was produced as described in Example 1, except the throughdrying fabric used was a Voith Fabrics t4803-7 and the transfer fabric was traveling 40% slower than the forming fabric and the basis weight of each ply was 13.6 gsm. The towel had a Vertical Absorbent Capacity of 13.72 g/g and a Wet Out Time of 1.0 seconds.

Example 17

The basesheet of a three-ply towel was produced as describe in Example 1, except the throughdrying fabric used was a Voith Fabrics t4803-7 and the basis weight of each ply was 13.6 gsm. The converting line was set up in such a way that three basesheet rolls were unwound, calendered using a steel/rubber calendar arrangement engaged at 5 mm of interference, plied together using crimping wheels, and rewound onto finished product cores. The resulting three-ply towel had a Vertical Absorbent Capacity of 14.02 grams per gram (g/g) and a Wet Out Time of 1.2 seconds.

Example 18

The basesheet of a three-ply towel was produced as describe in Example 1, except the throughdrying fabric used for the outer plies was t116-3, the throughdrying fabric for the center ply was a Voith Fabrics t4803-7 and the basis weight of each ply was 13.6 gsm.

The converting line was set up in such a way that three basesheet rolls were unwound, calendered using a steel/rubber calendar arrangement engaged at 5 mm of interference, plied together using crimping wheels, and rewound onto finished product cores. The resulting three-ply towel had a Vertical Absorbent Capacity of 14.48 grams per gram (g/g) and a Wet Out Time of 1.1 seconds.

Example 19

A two-ply towel was produced as described in Example 1, except the throughdrying fabric used was a Voith Fabrics t116-3 and the basis weight of each ply was 13.6 gsm. The towel had a Vertical Absorbent Capacity of 12.67 g/g and a Wet Out Time of 1.3 seconds.

Example 20

The basesheet of a three-ply towel was produced as describe in Example 1, except the throughdrying fabric used was a Voith Fabrics t116-3 and the basis weight of each ply was 13.6 gsm. The converting line was set up in such a way that three basesheet rolls were unwound, calendered using a steel/rubber calendar arrangement engaged at 5 mm of interference, plied together using crimping wheels, and rewound onto finished product cores. The resulting three-ply towel had a Vertical Absorbent Capacity of 13.87 grams per gram (g/g) and a Wet Out Time of 1.0 seconds.

Example 21

The basesheet of a three-ply towel was produced as describe in Example 1, except one of the outer plies was made with a Voith Fabrics t4803-7 throughdrying fabric at 40.7 gsm basis weight, and other plies were made with a Voith Fabrics t116-3 throughdrying fabric at 13.6 gsm basis weight. The converting line was set up in such a way that three basesheet rolls were unwound, calendered using a steel/rubber calendar arrangement engaged at 5 mm of interference, plied together using crimping wheels, and rewound onto finished product cores. The resulting three-ply towel had a Vertical Absorbent Capacity of 11.42 grams per gram (g/g) and a Wet Out Time of 1.5 seconds.

Example 22

A layered two-ply uncreped throughdried towel product was produced using the method substantially as illustrated in FIG. 1. More specifically, a two-layer towel basesheet was made in which the fabric side layer (TAD fabric contacting layer) fiber furnish comprised 100% bleached eucalyptus Kraft fiber (eucalyptus). Eucalyptus comprised about 30% of the total basesheet fiber by weight. The eucalyptus was curled using the method substantially as described in U.S. Pat. No. 5,772,845 issued to Farrington et al. entitled "Soft Tissue". Berocell 596 (Akzo Nobel) was added to the eucalyptus at about 2.3 kg per tonne of dry fiber. Kymene 557LX was added to the eucalyptus at about 11 kilograms per tonne of dry fiber.

The air side layer (layer not contacting the TAD fabric) comprised 100% bleached northern softwood Kraft fiber (softwood). The softwood was refined at about 36 kWh per tonne of dry fiber. Kymene 557LX was added to the softwood at about 11 kilograms per tonne of dry fiber. The headbox net slice opening was about 23 millimeters. The consistency of the stock fed to the headbox was about 0.12 weight percent.

The resulting wet tissue web was formed on a c-wrap twin-wire, suction form roll, former with outer forming fabric and inner forming fabric being Voith Fabrics 2164-B33 fabrics (commercially available from Voith Fabrics in Raleigh, N.C.). The speed of the forming fabrics was about 11.7 meters per second. The newly-formed wet tissue web was then dewatered to a consistency of about 25 percent using vacuum suction from below inner forming fabric before being transferred to transfer fabric, which was traveling at about 9.1 meters per second (28 percent rush transfer). The transfer fabric was a Voith Fabrics 2164-B33 fabric. A vacuum shoe pulling about 250 millimeters of mercury vacuum was used to transfer the wet tissue web to the transfer fabric.

The wet tissue web was then transferred to a throughdrying fabric (Voith Fabrics t116-3). The throughdrying fabric was traveling at a speed of about 9.1 meters per second. The wet tissue web was carried over a pair of Honeycomb throughdryers (commercially available from Valmet, Inc., Honeycomb Div. in Biddeford, Me.) operating at a temperature of about 200 degrees C and dried to final dryness of about 98 percent consistency. The sheet was calendered between the through air dryer and reel using a steel/rubber nip.

The resulting uncreped through air dried tissue web was converted into a two-ply towel. The plies were oriented with the eucalyptus layer to the outside and the softwood layer to the inside. Glued random pin to pin embossing was used to ply the sheets together. One roll comprised points arrayed in a "quilted diamond" pattern; the other roll comprised points arrayed in a substantially uniform "overall" pattern. The pin-to-pin gap between the rolls was about 25 micrometers. The plied sheet was wound into finished product rolls with the "quilted diamond" pattern to the outside of the finished product rolls. The resulting 2-ply towel basis weight was 43.7 gsm and had a Vertical Absorbent Capacity of 9.49 g/g and a Wet Out Time of 2.1 seconds.

Example 23: (Commercial Towel)

A sample of Kleenex® Brand VIVA® towel, procured in May 2002, was tested as described above. The 1-ply towel basis weight was 64.2 grams/square meter (gsm) and had a Vertical Absorbent Capacity of 8.09 grams per gram (g/g) and a Wet Out Time of 4.6 seconds.

Example 24: (Commercial Towel)

A sample of SCOTT® Towel, procured in January 2002, was tested as described above. The 1-ply towel basis weight was 41.6 gsm and had a Vertical Absorbent Capacity of 6.66 g/g and a Wet Out Time of 2.5 seconds.

Example 25: (Commercial Towel)

A sample of Brawny® towel, procured in March 2000, was tested as described above. The 2-ply towel basis weight was 46.3 gsm and had a Vertical Absorbent Capacity of 4.35 g/g and a Wet Out Time of 4.3 seconds.

Example 26: (Commercial Towel)

A sample of Coronet® towel, procured in March 2000, was tested as described above. The 1-ply towel basis weight was 51.1 gsm and had a Vertical Absorbent Capacity of 4.11 g/g and a Wet Out Time of 4.0 seconds.

Example 27: (Commercial Towel)

A sample of Sparkle® towel, procured in September 2001, was tested as described above. The 2-ply towel basis weight was 46.3 gsm and had a Vertical Absorbent Capacity of 4.11 g/g and a Wet Out Time of 2.7 seconds.

Example 28: (Commercial Towel)

A sample of Bounty Double Quilted™ R roll towel, procured in March 2002, was tested as described above. The 2-ply towel basis weight was 38.2 gsm and had a Vertical Absorbent Capacity of 10.84 g/g and a Wet Out Time of 3.1 seconds.

Example 29: (Commercial Towel)

A sample of Bounty Double Quilted™ XL roll towel, procured in June 2001, was tested as described above. The 2-ply towel basis weight was 45.6 gsm and had a Vertical Absorbent Capacity of 9.01 g/g and a Wet Out Time of 2.9 seconds.

Example 30: (Commercial Towel)

A sample of Bounty Double Quilted™ XXL roll towel, procured in June 2001, was tested as described above. The towel basis weight was 45.8 gsm and had a Vertical Absorbent Capacity of 8.75 g/g and a Wet Out Time of 2.6 seconds.

The results of the foregoing examples are summarized in Tables 1 and 2 below. For ease of comparison, FIG. 2 is a plot of the absorbent properties of the products of this invention (Examples 1–22) and the absorbent properties of commercially available products (Examples 23–30). As illustrated therein, the absorbent properties of the products of this invention are a significant improvement over what is available on the market today.

TABLE 1

| | Invention Samples | | | | | | | |
|---|---|---|---|---|---|---|---|---|
| | | | Ply 2 | | Ply 3 | | Vertical | |
| Example | Ply 1 | | Basis | | Basis | | Absorbent | Wet Out |
| ID Number | Basis Weight (gsm) | TAD Fabric | Weight (gsm) | TAD Fabric | Weight (gsm) | TAD Fabric | Capacity (g/g) | Time (sec) |
| 1 | 13.6 | t1203-2 | 13.6 | t1203-2 | | | 12.57 | 0.9 |
| 2 | 17.0 | t1203-2 | 17.0 | t1203-2 | | | 11.63 | 1.1 |
| 3 | 20.4 | t1203-2 | 20.4 | t1203-2 | | | 11.12 | 1.3 |
| 4 | 23.8 | t1203-2 | 23.8 | t1203-2 | | | 10.56 | 1.5 |
| 5 | 27.2 | t1203-2 | 27.2 | t1203-2 | | | 10.33 | 1.6 |
| 6 | 27.2 | t4803-7 | 27.2 | t4803-7 | | | 10.25 | 1.4 |
| 7 | 27.2 | t4803-7 | 27.2 | t4803-7 | 27.2 | t4803-7 | 11.41 | 1.3 |
| 8 | 27.2 | t4803-7 | 13.6 | t4803-7 | | | 10.66 | 1.2 |
| 9 | 27.2 | t116-3 | 27.2 | t116-3 | | | 10.56 | 1.5 |
| 10 | 20.4 | t116-3 | 27.2 | t116-3 | 20.4 | t116-3 | 11.37 | 1.6 |
| 11 | 20.4 | t116-3 | 20.4 | t116-3 | | | 11.46 | 1.1 |
| 12 | 20.4 | t4803-7 | 20.4 | t4803-7 | | | 11.82 | 1.1 |
| 13 | 20.4 | t4803-7 | 20.4 | t4803-7 | | | 11.67 | 1.3 |
| 14 | 20.4 | t4803-7 | 20.4 | t4803-7 | | | 11.60 | 1.1 |
| 15 | 13.6 | t4803-7 | 13.6 | t4803-7 | | | 12.71 | 1.0 |
| 16 | 13.6 | t4803-7 | 13.6 | t4803-7 | | | 13.72 | 1.0 |
| 17 | 13.6 | t4803-7 | 13.6 | t4803-7 | 13.6 | t4803-7 | 14.02 | 1.2 |
| 18 | 13.6 | t116-3 | 13.6 | t4803-7 | 13.6 | t116-3 | 14.48 | 1.1 |
| 19 | 13.6 | t116-3 | 13.6 | t116-3 | | | 12.67 | 1.3 |
| 20 | 13.6 | t116-3 | 13.6 | t116-3 | 13.6 | t116-3 | 13.87 | 1.0 |
| 21 | 40.7 | t4803-7 | 13.6 | t116-3 | 13.6 | t116-3 | 11.42 | 1.5 |
| 22 | 21.8 | t116-3 | 21.8 | t116-3 | | | 9.49 | 2.1 |

TABLE 2

| | Commercial Product Samples | | | | | |
|---|---|---|---|---|---|---|
| Example ID Number | Commercial Product Name | Month/ Year Purchased | Basis Weight (gsm) | Plies | Vertical Absorbent Capacity (g/g) | Wet Out Time (s) |
| 23 | VIVA ® | May/2002 | 64.2 | 1 | 8.09 | 4.6 |
| 24 | SCOTT ® | January/2002 | 41.6 | 1 | 6.66 | 2.5 |
| 25 | Brawny ® | March/2000 | 46.3 | 2 | 4.35 | 4.3 |
| 26 | Coronet ® | March/2000 | 51.1 | 1 | 4.11 | 4.0 |
| 27 | Sparkle ® | September/2001 | 46.3 | 2 | 4.11 | 2.7 |
| 28 | Bounty Double Quilted ™ R | March/2002 | 38.2 | 2 | 10.84 | 3.1 |
| 29 | Bounty Double Quilted ™ XL | June/2001 | 45.6 | 2 | 9.01 | 2.9 |
| 30 | Bounty Double Quilted ™ XXL | June/2001 | 45.8 | 2 | 8.75 | 2.6 |

It will be appreciated that the foregoing examples, given for purposes of illustration, to be construed as limiting the scope of this invention, which is defined by the following claims and all equivalents thereto.

We claim:

1. A multi-ply paper sheet having two or more plies, said sheet having a Vertical Absorbent Capacity of about 8.0 grams of water or greater per gram of fiber and a Wet Out Time of 2.3 seconds or less.

2. The paper sheet of claim 1 wherein the Wet Out Time is about 2.0 seconds or less.

3. The paper sheet of claim 1 wherein the Wet Out Time is about 1.5 seconds or less.

4. The paper sheet of claim 1 wherein the Wet Out Time is from about 0.5 seconds to 2.3 seconds.

5. The paper sheet of claim 1 wherein the Wet Out Time is from about 0.5 seconds to about 2.0 seconds.

6. The paper sheet of claim 1 wherein the Vertical Absorbent Capacity is about 10.0 grams of water or greater per gram of fiber.

7. The paper sheet of claim 1 wherein the Vertical Absorbent Capacity is about 12 grams of water or greater per gram of fiber.

8. The paper sheet of claim 1 wherein the Vertical Absorbent Capacity is from about 8 grams of water per gram of fiber to about 16 grams of water per gram of fiber.

9. The paper sheet of claim 1 wherein the Vertical Absorbent Capacity is from about 10 grams of water per gram of fiber to about 15 grams of water per gram of fiber.

10. The paper sheet of claim 1 wherein the Wet Out Time is from about 0.5 seconds to about 2.0 seconds and the Vertical Absorbent Capacity is from about 9.0 grams of water per gram of fiber to about 15.0 grams of water per gram of fiber.

11. The paper sheet of claim 1 wherein the number of plies is two.

12. The paper sheet of claim 1 wherein the number of plies is three.

13. A multi-ply paper towel having two or more through-dried plies, said towel having a Vertical Absorbent Capacity of about 8.0 grams of water or greater per gram of fiber and a Wet Out Time of 2.3 seconds or less.

14. The paper towel of claim 13 wherein the Wet Out Time is about 2.0 seconds or less.

15. The paper towel of claim 13 wherein the Wet Out Time is about 1.5 seconds or less.

16. The paper towel of claim 13 wherein the Wet Out Time is from about 0.5 seconds to about 2.3 seconds.

17. The paper towel of claim 13 wherein the Wet Out Time is from about 0.5 seconds to about 2.0 seconds.

18. The paper towel of claim 13 wherein the Vertical Absorbent Capacity is about 10.0 grams of water or greater per gram of fiber.

19. The paper towel of claim 13 wherein the Vertical Absorbent Capacity is about 12 grams of water or greater per gram of fiber.

20. The paper towel of claim 13 wherein the Vertical Absorbent Capacity is from about 8 grams of water per gram of fiber to about 16 grams of water per gram of fiber.

21. The paper towel of claim 13 wherein the Vertical Absorbent Capacity is from about 10 grams of water per gram of fiber to about 15 grams of water per gram of fiber.

22. The paper towel of claim 13 wherein the Wet Out Time is from about 0.5 seconds to about 2.0 seconds and the Vertical Absorbent Capacity is from about 9.0 grams of water per gram of fiber to about 15.0 grams of water per gram of fiber.

23. The paper towel of claim 13 wherein the number of throughdried plies is two.

24. The paper towel of claim 13 wherein the number of throughdried plies is three.

25. The paper towel of claim 13 wherein the number of throughdried plies is four.

26. A multi-ply paper towel having two or more uncreped throughdried plies, said towel having a Vertical Absorbent Capacity of about 8.0 grams of water or greater per gram of fiber and a Wet Out Time of 2.3 seconds or less.

27. The paper towel of claim 26 wherein the Wet Out Time is about 2.0 seconds or less.

28. The paper towel of claim 26 wherein the Wet Out Time is about 1.5 seconds or less.

29. The paper towel of claim 26 wherein the Wet Out Time is from about 0.5 seconds to about 2.3 seconds.

30. The paper towel of claim 26 wherein the Wet Out Time is from about 0.5 seconds to about 2.0 seconds.

31. The paper towel of claim 26 wherein the Vertical Absorbent Capacity is about 10.0 grams of water or greater per gram of fiber.

32. The paper towel of claim 26 wherein the Vertical Absorbent Capacity is about 12 grams of water or greater per gram of fiber.

33. The paper towel of claim 26 wherein the Vertical Absorbent Capacity is from about 8 grams of water per gram of fiber to about 16 grams of water per gram of fiber.

34. The paper towel of claim 26 wherein the Vertical Absorbent Capacity is from about 10 grams of water per gram of fiber to about 15 grams of water per gram of fiber.

35. The paper towel of claim 26 wherein the Wet Out Time is from about 0.5 seconds to about 2.0 seconds and the Vertical Absorbent Capacity is from about 9.0 grams of water per gram of fiber to about 15.0 grams of water per gram of fiber.

36. The paper towel of claim 26 wherein the number of uncreped throughdried plies is two.

37. The paper towel of claim 26 wherein the number of uncreped throughdried plies is three.

38. The paper towel of claim 26 wherein the number of uncreped throughdried plies is four.

* * * * *